United States Patent [19]

Kato

[11] Patent Number: 5,045,647

[45] Date of Patent: Sep. 3, 1991

[54] INTERLOCKING DEVICE FOR PUSH-BUTTON SWITCH

[75] Inventor: Shigeru Kato, Osaka, Japan

[73] Assignee: Shinkoh Electric To., Ltd., Osaka, Japan

[21] Appl. No.: 491,426

[22] Filed: Mar. 9, 1990

[51] Int. Cl.[5] ..... H01H 9/20

[52] U.S. Cl. ..... 200/5 E; 74/483 PB; 200/50 C

[58] Field of Search ..... 200/5B-5E, 200/50C; 74/483 PB

[56] References Cited

U.S. PATENT DOCUMENTS

| | | | |
|---|---|---|---|
| 2,523,786 | 9/1950 | Soreng | 200/5 B |
| 2,713,092 | 7/1955 | Rocks et al. | 200/50 C X |
| 3,674,948 | 7/1972 | Betlejewski et al. | 200/5 B X |
| 4,356,363 | 10/1982 | Harbauer et al. | 200/50 C |

FOREIGN PATENT DOCUMENTS

| | | |
|---|---|---|
| 32-551 | 2/1932 | Japan . |
| 39-28139 | 9/1939 | Japan . |

*Primary Examiner*—J. R. Scott

*Attorney, Agent, or Firm*—Wenderoth, Lind & Ponack

[57] ABSTRACT

A push button switch having an interlocking device, the switch having a pair of two spaced adjacent push buttons each movable downwardly from an inoperative to an operative position, a pin position between the two push buttons and having a horizontal longitudinal axis extending transversely to a vertical plane between the push buttons and around which the pin is rotatable, and an interlocking lever extending between the push buttons and having opposite ends engaged with respective ones of the push buttons for tilting the lever when the push buttons are moved, the interlocking lever having a fulcrum projecting downwardly from the central portion thereof and, when both the push buttons are in the inoperative position, having the lower end supported on the rotatable pin, and movable for, when one of the push buttons is moved downwardly, being tilted toward the downwardly moved push button and having the fulcrum moved around the pin to a position on the opposite side of the pin from the downwardly moved push button, whereby downward movement of the other push button is blocked by the lever being blocked against tilting movement toward the other push button by the engagement of the fulcrum with the pin.

2 Claims, 2 Drawing Sheets

INTERLOCKING DEVICE FOR PUSH-BUTTON SWITCH

BACKGROUND OF THE INVENTION

1. Field of the Invention

This invention relates to an interlocking device for a small size push button switch which has a simple mechanical construction and effects accurate interlocking.

2. Description of the Prior Art

In a push button switch, an interlocking device which prevents two push buttons from being pushed down simultaneously is required in order to avoid breaking of the switch caused by simultaneous operation of two push buttons.

Commonly used interlocking devices for push button switches are disclosed, for example, in Japanese Utility Model Registration Application Publications No. 32-551 and No. 39-28139. These devices have a construction in which an interlocking rod is disposed between two adjacent push buttons for movement in a lateral direction in a switch so that when either one of the two push buttons is pushed down, the interlocking rod is moved toward the other push button for locking it against movement.

The above conventional interlocking system has a complicated construction, requires many parts and is difficult to assemble, especially in the case where spring and balls are used.

The present invention has been made in view of the drawbacks of the conventional devices.

SUMMARY OF THE INVENTION

The present invention has the following construction. A groove is provided between two push buttons in which an interlocking lever swings in a seesaw manner, each end portion of the interlocking lever being fitted in a corresponding push button. A projection is formed at the center of the undersurface of the lever which acts as fulcrum and a pin which is engaged by the projection or the fulcrum is rotatably mounted in the switch and extends in a direction intersecting the groove.

With the above construction, when either one of the two push buttons is pushed down, in response to this pushing down the interlocking lever swings in a seesaw manner, whereby the end of the lever opposite the end engaged by the pushed down switch is pushed up as shown in FIG. 5(B) and the push button by the pushed up end is locked, namely, it cannot be pushed down. When the pushed down push button is pushed down still further, the fulcrum of the interlocking lever moves as it swings on the outer periphery of the pin. At this time, the lever moves laterally toward the pushed up push button and the pin also rotates a little, whereby the fulcrum of the lever is prevented from wearing, and locking of the pushed up push button is made more certain. Due to this movement, interlocking can be carried out accurately even if the pushing down action is made in two steps or three steps.

BRIEF DESCRIPTION OF THE DRAWINGS

The nature and advantage of the present invention will be understood more clearly from the following description made with reference to the accompanying drawings, in which.

DETAILED DESCRIPTION OF THE INVENTION

Figure 1:
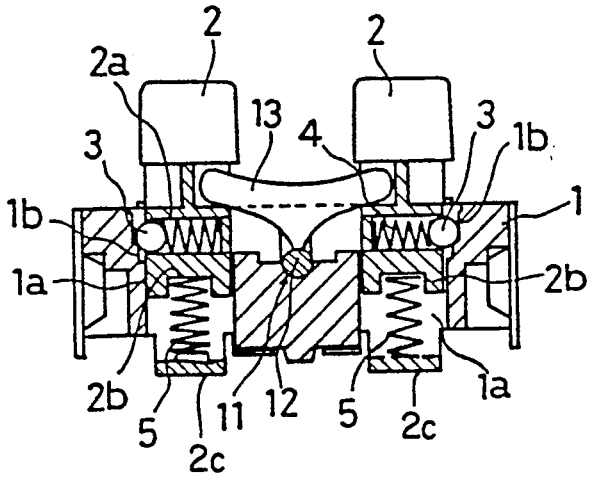
FIG. 1 is a longitudinal section of an interlocking device for a push button switch according to the present invention.
Figure 2:
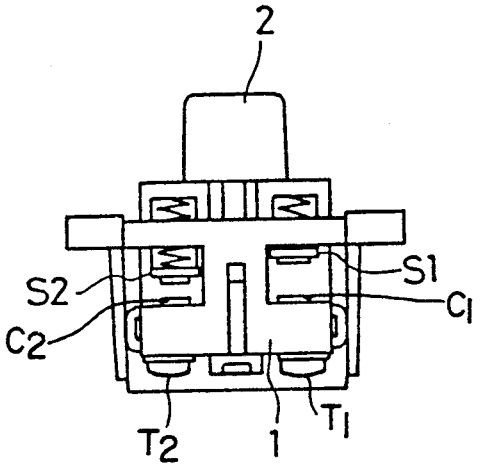
FIG. 2 is an end elevation view of the push button switch of FIG. 1.
Figure 3:
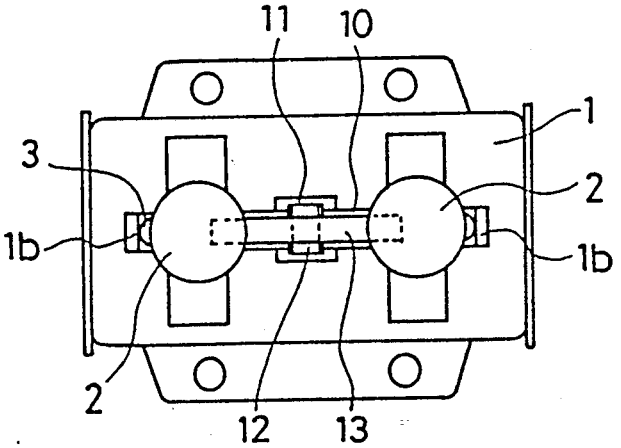
FIG. 3 is a plan view of the push button switch shown in FIG. 2.
Figure 4:
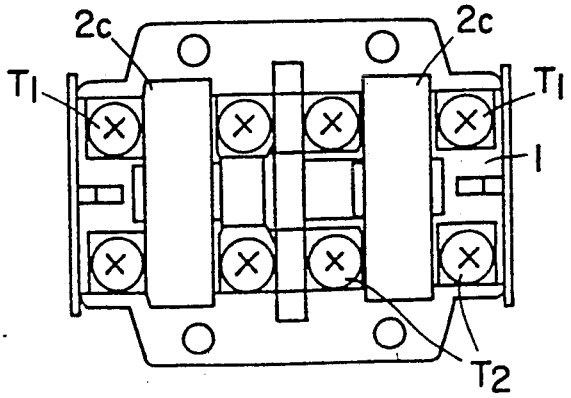
FIG. 4 is a bottom view of the push button switch shown in FIG. 2.

In the drawings, reference numeral 1 designates a push button switch proper. Two spaced adjacent push button receiving holes 1*a* are provided in the switch 1 in which push buttons 2 are slidably mounted. A vertical guide groove 1*b* is provided at the upper part of the inside surface of the outer side of each push button receiving hole 1*a* and a guide ball 3 is fitted therein for two-step operation of the push button. The guide ball 3 is movable into the push button receiving hole la from the guide groove 1*b*.

Each push button 2 has a shape such that it can be slidably fitted in the corresponding push button receiving hole 1*a* and slide in the vertical direction of the switch, and also has a lateral hole 2*a* extending in the lateral direction of the push button, with one end thereof blocked. A corresponding guide ball 3 is inserted in each lateral hole 2*a*, and a ball spring 4 is interposed between the ball 3 and the inner bottom of the blocked end of the lateral hole 2*a*. The guide ball 3 is urged laterally outward of the push button 2 by the biasing force of the ball spring 4, whereby when the push button 2 is inserted into the corresponding push button receiving hole 1*a*, the guide ball 3 is pressed against the surface of the guide groove 1*b* by the biasing force of the ball spring 4. A spring receiving hole 2*b* is provided at the center of the bottom of each push button 2 and a button biasing spring 5 is interposed between the spring receiving hole 2*b* and a bottom piece 2*c* over the bottom of the push button receiving hole la of the switch 1 so that when the push button 2 is inserted in the switch 1, the push button 2 is always urged upwardly by the button biasing spring 5. In order to prevent the push button 2 from coming out of the switch 1 due to the biasing force of the button biasing spring 5, the push button 2 is held by movable contact pieces $S_1$ and $S_2$ which extend through the push button 2 in a lateral horizontal direction and move toward and away from fixed contacts $C_1$ and $C_2$ connected to terminals $T_1$ and $T_2$ fixed to the bottom of the switch.

A groove 10 is formed in the top surface of the switch 1 in such a fashion that it connects the two push button receiving holes 1*a* which are spaced from and adjacent each other. Pin receiving recesses 11 are formed at a substantially central part of the groove 10 and in opposite inner surfaces of the groove 10. A roller-shape pin 12 is fitted rotatably in the pin receiving recesses 11 and extending transversely of the groove 10, and an interlocking lever 13 is fitted in the groove 10.

The interlocking lever 13, as illustrated in detail in FIGS. 1 and 5, has a size and shape suitable for being fitted in the groove 10 and also has a fulcrum 13*a* of triangular shape at the under surface of the central part thereof. This fulcrum 13*a* makes contact at a free end thereof with a part of the outer peripheral surface of the pin 12.

Respective end portions of the interlocking lever 13 are fitted in lever receiving holes 2c in the inner side surface of the corresponding push buttons 2.

An explanation of the operation of the push button switch of the above construction will be given with reference to FIG. 5.

Figure 5A:
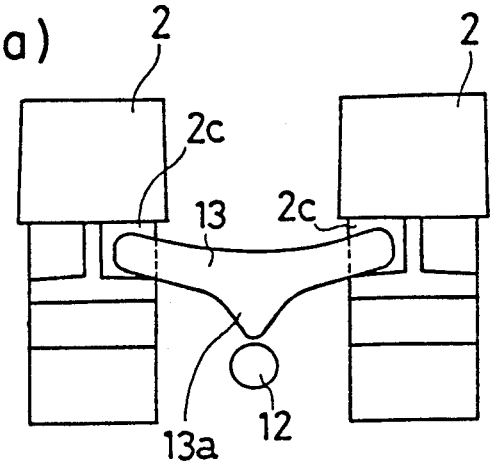
FIGS. 5(A)–5(C) are diagrammatic views showing the operation, and the relation between the push buttons and the interlocking lever during operation.
Figure 5B:
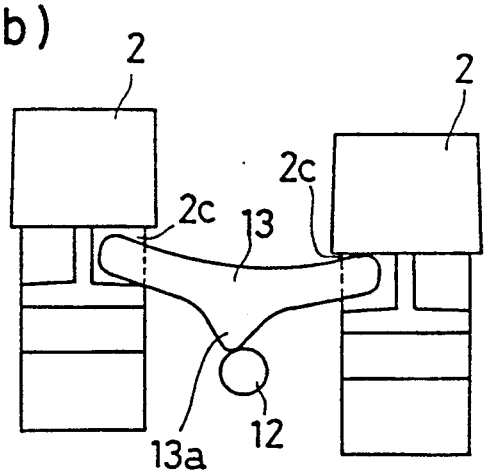

FIG. 5(A) shows the OFF state where neither of the two push buttons 2 is pushed down. When the push button 2 on the right side is pushed down (first-step operation), as shown in FIG. 5(B), in response to this pushing down of the push button on the right side the interlocking lever 13 with its free ends fitted in the push buttons, is supported at the fulcrum 13*a* and the right side is pushed down and the lever tilts to the right. In this state, pushing down the push button on the left side is impossible because the lower part of the fulcrum 13*a* has been swung to the left and moved slightly downwardly partly beside the pin 12 and blocks tilting movement of the lever to the left; in other words, the push button 2 on the left side is in a locked state.

Figure 5C:
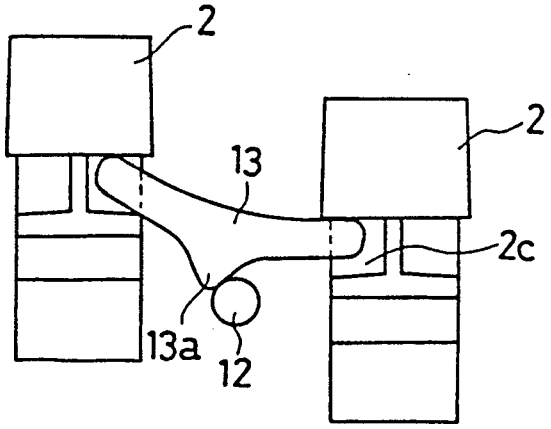

When the push button 2 on the right side is pushed down still further (second-step operation), it tilts the lever 13 further to the right to the position shown in FIG. 5(C). Thus, when the push button on the right side is pushed down further from the state shown in FIG. 5(B), the interlocking lever 13 is further tilted so that the fulcrum 13*a* moves further down beside the pin 12, because the pin 12 rotates and the fulcrum 13*a* moves toward the left and makes contact with the pin 12 at a position lower than the top surface of the pin 12. At this time, because the fulcrum 13*a* is kept in contact with and is held by the pin 12, the interlocking lever 13 is strongly blocked against swinging, and is in a locked state.

When the force pushing down the push button on the right side is released, the push button reverts to its original position automatically due to the biasing force of the spring 5 for that push button. At this time, the interlocking lever 13 with its right end fitted in this push button also reverts to its original position or to the state shown in FIG. 5(A).

In the case of the push button on the left, the operation action is the opposite of that described above, namely, the push button on the right side is put in a locked state at the first-step and second-step operations of the push button on the left.

In a push button switch where two push buttons are adjacent to and spaced from each other can be pushed down simultaneously, the present invention provides a groove in which an interlocking lever is provided which swings in seesaw fashion between two push buttons. The end portions of the lever are fitted in recesses in the inner side surface of each push button, and a projection which acts as a fulcrum is formed at the center of the under surface of the lever for engaging the side of a pin which is rotatably transversely fitted in the groove in the direction intersecting the groove. Thus, the present invention has a simple construction which makes it possible to carry out interlocking accurately and the switch can be locked at the time of both the first-step operation and the second-step operation.

I claim:

1. A push-button switch having an interlocking device, said switch comprising:

two spaced side-by-side push-buttons each movable downwardly in substantially parallel directions from an inoperative to an operative position;

means supporting said push-buttons for said movement;

a pin positioned between said two push-buttons and having a horizontal longitudinal axis extending transversely to a vertical plane between said push-buttons;

means supporting said pin so as to be free to rotate around said axis;

an interlocking lever extending between said push-buttons and having opposite ends engaged with respective ones of said push-buttons, said interlocking lever having a fulcrum projecting downwardly from the central portion thereof and, when both said push-buttons are in the inoperative position, having the lower end supported on said rotatable pin; and means supporting said lever for tilting movement in one or the other direction around said fulcrum depending on which push-button is pushed downwardly and for maintaining engagement of the ends of said lever in engagement with said push-buttons during tilting movement, said lever being movable for, when one of the push-buttons is moved downwardly, being tilted toward the downwardly moved push-button and having the fulcrum engaging said pin and causing said pin to rotate in the opposite direction from the tilting direction of said lever to move the lower end of said fulcrum to a position on the opposite side of the pin from the downwardly moved push-button, whereby downward movement of the other push-button is blocked by the lever being blocked against tilting movement toward the other push-button by the engagement of the fulcrum with the pin.

2. A push-button switch as claimed in claim 1 in which said means for supporting said push-buttons is a switch body having push-button receiving holes therein in which said push-buttons are movable and said means supporting said lever is a lever receiving groove extending between said receiving holes in which said interlocking lever is tiltable, and said means supporting said pin are pin receiving recesses on opposite sides of said lever receiving groove in which the ends of said pin are mounted so as to be free to rotate.

* * * * *